United States Patent [19]

Budinski

[11] 4,441,462

[45] Apr. 10, 1984

[54] HYBRID MECHANICAL AND ELECTRICAL DRIVE AND ENGINE COOLING FAN ARRANGEMENT

[75] Inventor: John A. Budinski, Jamestown, Ohio

[73] Assignee: General Motors Corporation, Detroit, Mich.

[21] Appl. No.: 402,751

[22] Filed: Jul. 28, 1982

[51] Int. Cl.[3] ..... F01P 5/04

[52] U.S. Cl. ..... 123/41.11; 123/41.12; 123/41.49

[58] Field of Search ..... 123/41.14, 41.12, 41.49, 123/41.65, 41.66, 195 A

[56] References Cited

U.S. PATENT DOCUMENTS

| | | | |
|---|---|---|---|
| 2,906,097 | 9/1959 | Wacker | 60/718 |
| 3,444,748 | 5/1969 | Sutaruk | 474/70 |
| 3,894,521 | 7/1975 | Sakasegawa et al. | 123/41.49 |
| 4,257,554 | 3/1981 | Willingham | 123/41.12 |
| 4,373,482 | 2/1983 | Goscenski, Jr. | 123/41.65 |

*Primary Examiner*—William A. Cuchlinski, Jr.
*Attorney, Agent, or Firm*—Charles R. White

[57] ABSTRACT

A hybrid fan drive system for cooling an internal combustion engine which incorporates (1) an electric motor drive which drives the fan at a predetermined speed independent of engine speed, and (2) an engine driven variable speed drive operatively interconnecting the vehicle engine to the fan for engine drive of the fan at speeds in accordance with engine speed above a predetermined output speed to optimize cooling of the engine.

4 Claims, 6 Drawing Figures

HYBRID MECHANICAL AND ELECTRICAL DRIVE AND ENGINE COOLING FAN ARRANGEMENT

This invention relates to cooling of internal combustion engines and more particularly to a hybrid drive and engine cooling fan arrangement featuring electric drive of the fan during low engine speed including idle and mechanical drive of the fan as engine speed increases from a predetermined speed above idle.

With the advent of transversely mounted engines for front wheel vehicle propulsion, electric motors have been used in many installations for driving the associated vehicle engine cooling fan to induce the flow of cooling air through a forwardly mounted radiator to the engines. While such electric fan drives have been highly satisfactory, they often do not meet new and higher standards for increased cooling power primarily due to inherent restraints and limitations in the electrical system of the vehicle. To increase the cooling capacity of such electrically driven fans, extensive redesign and rebuild of the electrical system in a vehicle is required. To eliminate such redesign requirements and the attendant expenses, special mechanical drive and fan arrangements have been employed or proposed for use with transversely mounted engines. With such mechanical drives, the size of the fan needed to be increased to provide sufficient cooling of the engine when the engine is idling and fan speeds are low. However, such large diameter fans have a tendency to overcool the engine and waste power when driven by the engine at high speed. In response to the need for optimizing engine cooling, this invention provides a hybrid electric and mechanical drive and engine cooling fan arrangement which is appropriately matched to the cooling requirements for a wide range of vehicle operations.

With the hybrid or dual drive system of the present invention, a small fan is employed which is electrically driven at a fixed high speed during idle and mechanically driven at variable speeds preferably proportional to engine speed during vehicle operation to unload the electrical system of the vehicles. The electric motor drives the fan at high speeds during engine idle condition to thereby eliminate the requirement for an oversized fan otherwise required if powered directly from the engine. As engine speeds increase beyond idle with this invention a mechanical flex shaft drive into the fan exceeds the electric motor speed for fan drive to provide cooling power far in excess of that provided by the electric motor. If desired, a suitable thermostatically controlled clutch arrangement can be employed in the mechanical drive and a switch in the electric to interrupt such drives during vehicle operations in which fan cooling is not required.

In this invention the drive fan package preferably comprises a low profile motor and a cable driven from the back of the engine powered alternator drives an overrunning clutch with a geared reduction to the fan. At high engine speeds the cable drives the fan while at low engine speeds, i.e., idle, the electric motor drives the fan. With the present invention the cable/electric fan drive package will out-perform an all electric or an all mechanical drive to provide an improved fan drive for diesel and other sparking internal combustion engines.

It is a feature, object and advantage of this invention to provide an improved automobile engine cooling fan and fan drive arrangement providing more efficient and effective use of available energy within a power plant of a vehicle.

Another feature, object and advantage of this invention is to provide a new and improved dual drive engine cooling fan system comprising an electric motor for driving the fan at engine idle and mechanical cable drive input to an over-running clutch with a gear reduction to the fan at higher engine speeds.

These and other features, objects and advantages of the invention will become more apparent from the following detailed description and drawings in which.

Figure 1:
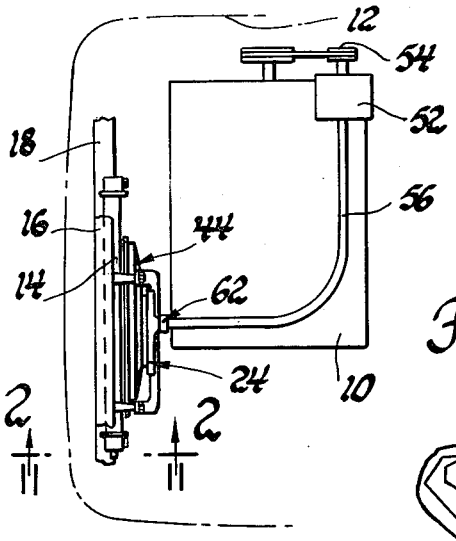
FIG. 1 is a top plan schematic view of the dual drive engine cooling fan of this invention.
Figure 2:
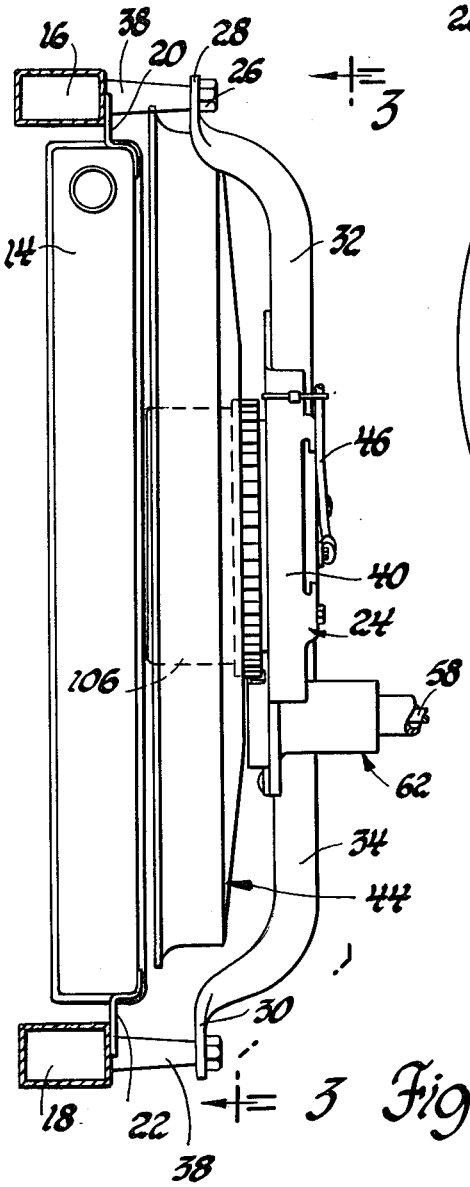
FIG. 2 is a view partly in cross-section taken along lines 2—2 of FIG. 1.
Figure 3:
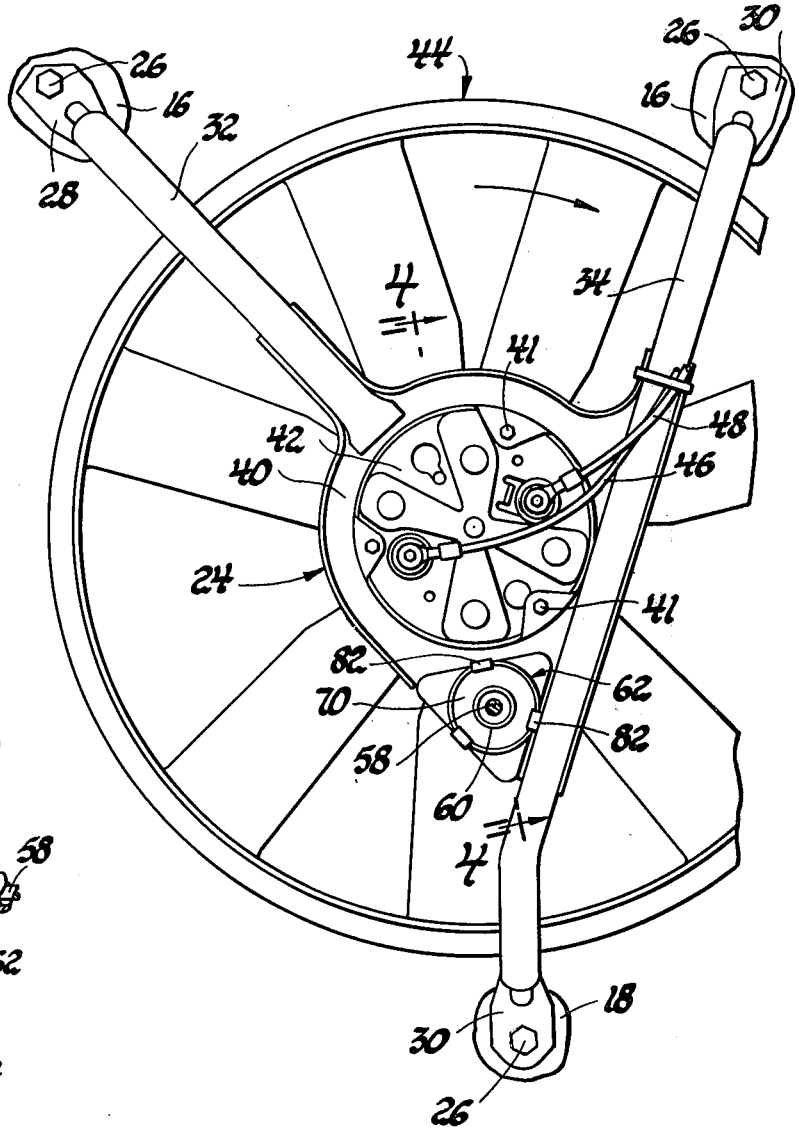
FIG. 3 is an end view taken along lines 3—3 of FIG. 2.

Turning now in greater detail to the drawings, there is diagrammatically shown in FIG. 1 an internal combustion engine 10 transversely arranged in a power plant compartment of a vehicle 12. Disposed at the outer side of the engine and the front of the vehicle is a radiator 14 hydraulically connected to the internal combustion engine 10 for circulating cooling fluid therethrough and to receive ram air for dispersing the heat energy of the engine coolant. This radiator is mounted to conventional upper and lower radiator supports 16, 18 by sheet metal brackets 20 and 22. A fan motor mounting bracket 24 is connected immediately behind radiator 14 by threaded fasteners 26 which extend through end pads 28, 30 of extending arms 32, 34 of the fan motor mounting bracket and into threaded connection with the radiator supports 16, 18. The threaded fasteners 26 project through spacers 38 which accurately fix the distance of the fan motor mounting bracket 24 behind the radiator to insure proper fan clearances and to space the fan for maximized fan pumping efficiency. The mounting bracket 24 has a flat centralized hub portion 40 to which arms 32 and 34 are attached. A low profile electric motor 42 is supported in the hub 40 by screws 41. The motor has a forwardly extending output shaft 43 drivingly connected to a multi-bladed and shrouded fan 44. When the fan circuit of the vehicle electrical system represented by electrical leads 46 and 48 is energized, the fan 44 will be driven at constant speed by the electric motor and a stream of cooling air is induced to flow through the radiator under idle and other low speed engine conditions as will be further pointed out below so that heat energy of engine coolant circulating therethrough is dissipated until the coolant reaches a predetermined lower temperature level.

Since the electrical power capacity of a vehicle is generally quite limited and since an all electrical engine cooling fan drive may unduly burden some vehicle electrical systems, this invention provides for an auxiliary, variable speed, mechanical drive of the fan to unload the electrical system under predetermined operating conditions. With this invention during idle and low speed engine operation the fan is electrically driven at substantially constant speed to provide optimized cooling. Subsequently when engine speed increases to a selected predetermined speed, a mechanical drive takes over and drives the fan at speeds preferably proportional to engine speed. With this mechanical drive active, the limited electrical energy of the vehicle is effectively conserved by the fan drive.

FIG. 1 which diagrammatically illustrates the hybrid electrical-mechanical drive of this invention includes an alternator 52 conventionally driven by the engine 10 through a belt and pulley system 54. A flexible drive cable assembly 56 comprising a central rotatable cable 58 rotatably driven off of the end of alternator 52 is operatively mounted within a cylindrical sheath or protective cover 60. This drive cable assembly terminates in a connector end for fitting 62 for the releasable drive attachment with the fan 44.

Figure 4:
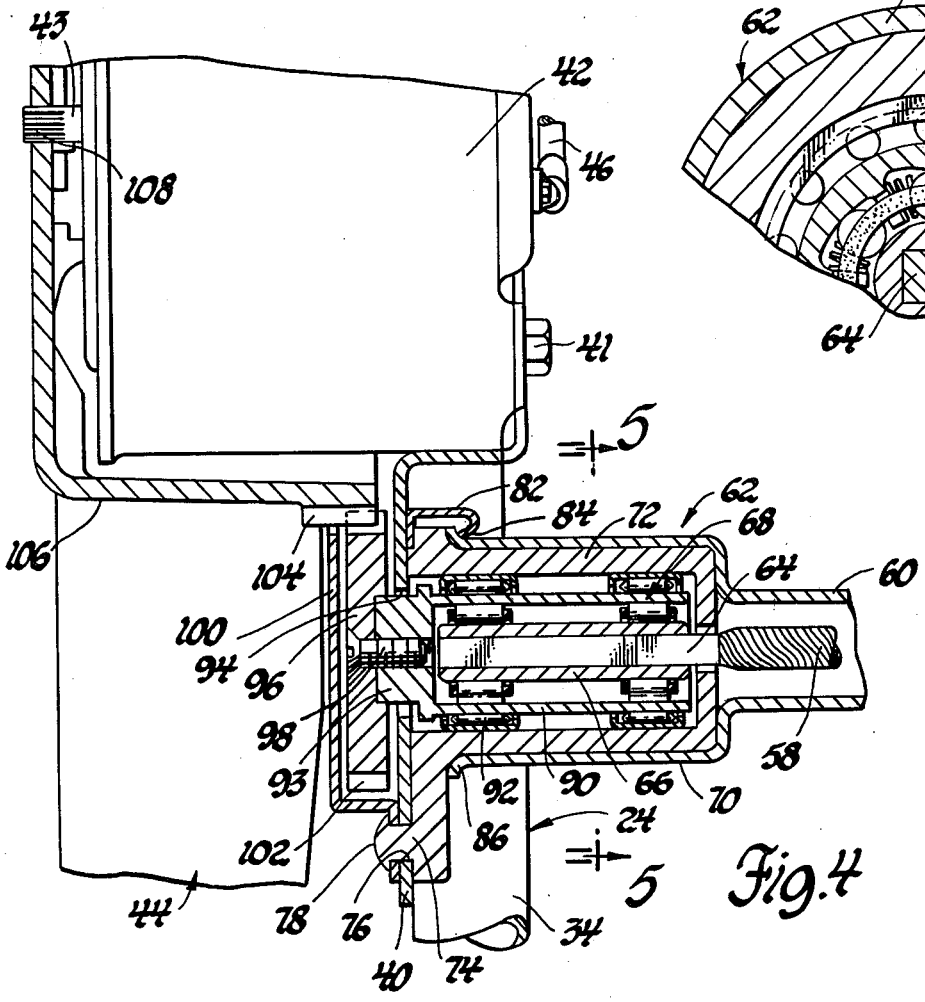
FIG. 4 is a view partly in section taken along lines 4—4 of FIG. 3.
Figure 5:
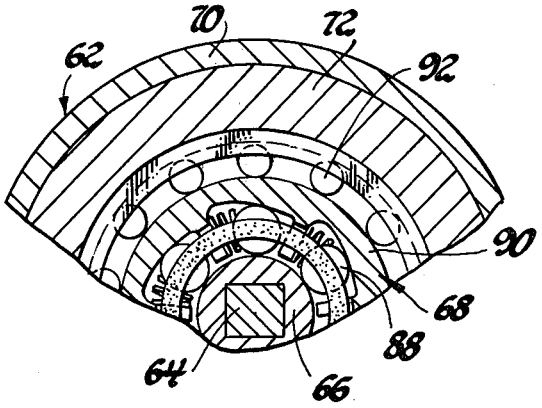
FIG. 5 is a partial view taken along lines 5—5 of FIG. 4.

FIG. 4 illustrates details of the fitting 62 which includes squared terminal end 64 of cable 58 that closely fits into a corresponding squared recess in an inner race 66 of a one-way clutch 68. The fitting 62 further comprises a cylindrical outer cover 70 enlarged from the end of sheath 60 that fits over the cylindrical housing 72 of the one-way clutch 68. This housing is secured to the hub 40 of the mounting bracket 24 by projection 74 extending from the housing which protrudes through opening 76 in the hub and is suitably headed at 78 for the retention. The outer cover 70 is secured to the housing 72 by spring clips 82 each generally L-shaped having a lower leg sandwiched between the base of the housing 72 and hub 40. The free end of each clip 82 is hooked inwardly at 84 to releasably catch the outwardly flared lower end 86 of the outer cover 70 of the fitting. With this arrangement the quick axial snap fit coupling and uncoupling of the mechanical drive cable and the one-way clutch is provided.

The one-way clutch 68 has rollers 88 operatively interposed between the inner race 66 and a cylindrical outer race 90. The outer race 90 is rotatably mounted in housing 72 by needle bearing 92 and has a squared inner end 93 that extends through an opening 94 in the hub 40 and into drive engagement with a squared recess of a spur gear 96 and is secured thereto by a screw 98. This spur gear is disposed beneath a cover 100 mounted to the front side of the hub by the projection 74. The spur gear 96 has external teeth 102 which mesh with the external teeth 104 formed on the periphery of cylindrical hub 106 of the fan 44. This hub is centrally keyed or splined at 108 to the output shaft 43 of the electric motor for the motor drive of the fan.

Figure 6:
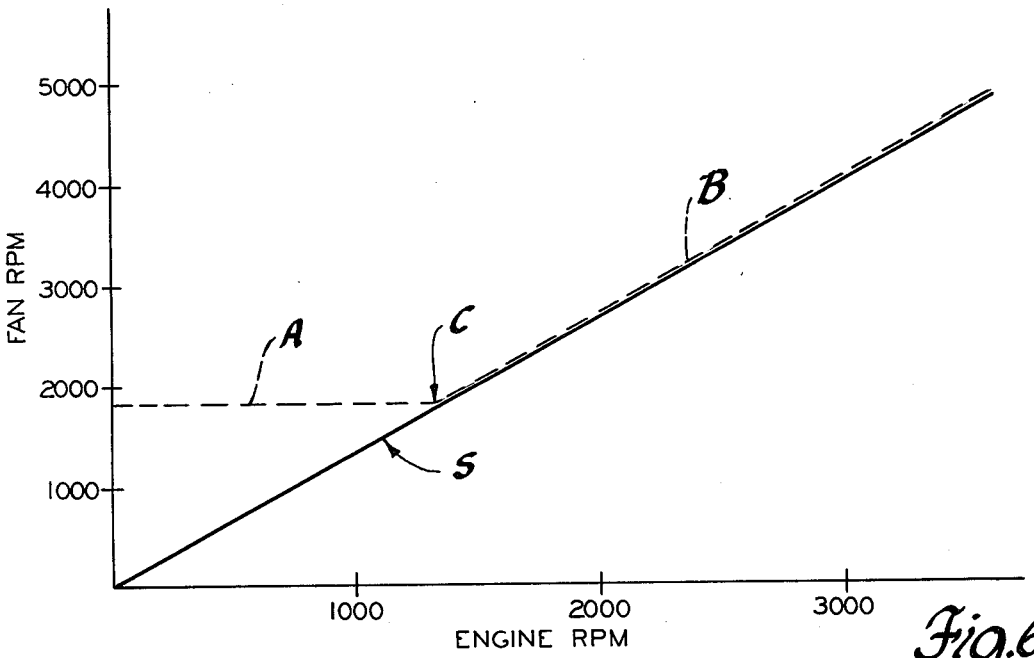
FIG. 6 is a graph illustrating operation of the dual drive engine cooling system of this invention.

FIG. 6 illustrates a preferred operation of this invention. At idle and at low engine speed shown as full straight line curve S, the engine drive of the cable 58 is low as compared to the output of the electric motor. Under such conditions the fan is driven at a constant speed, 1800 rpm for example, by the electric motor illustrated by segment A of the operational curve C. The one-way clutch 68 provides the overrun of the mechanical drive by the faster output of electric motor. At engine speeds above a predetermined engine speed, 1400 rpm for example, the mechanical drive through the drive cable will effect lockup of the one-way clutch so that the mechanical drive drives the fan as shown by segment B of the operational curve. Accordingly, on clutch lockup the fan speed will increase progressively along with progressing engine speeds to provide for engine driving of the fan with the electrical system being unloaded through the mechanical drive. If desired, a suitable one-way clutch or other clutching device could be employed between the output of the electric motor and the fan to permit mechanical drive of the fan without drive of the motor armature.

From the above it will be understood that this invention provides a dual power path fan drive combining the best features of the electrically driven fan which is severely limited in power output due to restraints inherent in the electrical system of the vehicle and the engine driven fan with considerably more power capabilities. In the preferred embodiment the flexible shaft provides one power path driven by the alternator but can be powered by other engine driven sources. While the flexible shaft drives the cooling fan through gears molded as part of the fan, the gearing could also be build into the motor. With this invention a hybrid fan drive system is provided that closely matches the engine cooling needs while using only the amount of energy actually needed to do the job to thereby provide a significant energy savings. In addition to the above, an electric clutch could be included in the flexible shaft to save energy and increase the life of the system when the mechanical drive is not required. If desired, a belt and pulley system or other transmission could be used instead of gears for the drive.

The invention in which an exclusive property or privilege is claimed are defined as follows:

1. An automotive engine cooling fan and drive assembly for maintaining airflow through a radiator in which coolant from an associated internal combustion engine is circulated comprising a support, primary motor means comprising an electric motor mounted on said support having a rotatable output, a bladed fan directly supported by said output and directly rotatably driven thereby for inducing the flow of air through said radiator, auxiliary fan drive means having an output drivingly connected to said bladed fan for the rotatable drive thereof, control means interposed in said auxiliary drive means establishing a first condition of operation in which said primary motor means powers said fan and a second condition of operation in which said auxiliary fan drive powers said fan.

2. An automotive engine cooling fan and drive assembly for maintaining airflow through a radiator in which coolant from an associated internal combustion engine is circulated comprising a support adjacent to the radiator, electric motor means mounted on said support having a rotatable output, a bladed fan directly supported by said output and directly rotatably driven thereby for inducing the flow of air through said radiator, engine driven auxiliary fan drive means having an output drivingly connected to said bladed fan for the rotatable drive thereof, clutch means interposed in said auxiliary drive means having a released condition of operation in which said electric motor means powers said fan when said engine is operating at idle speed and an engaged condition of operation in which said engine driven auxiliary fan drive powers the fan for a range of engine speeds greater than idle speed.

3. An automotive engine cooling fan and drive assembly for maintaining airflow through a forward mounted radiator in which coolant from an associated transversely mounted internal combustion engine is circulated comprising a support adjacent to the radiator, electric motor means mounted on said support having a rotatable output, a bladed fan directly and forwardly supported by said output and rotatably driven thereby for inducing the flow of air through said radiator, a flexible cable providing a mechanical drive means from said engine having an output drivingly connected to said bladed fan for the rotatable drive of said fan, overrunning clutch means interposed in said mechanical drive means operative so that said electric motor means powers said fan at low engine speed including idle and said mechanical drive powers the fan for a range of engine speeds above a predetermined engine speed.

4. In a vehicle, an automotive engine cooling fan and drive assembly for establishing a flow of cooling air through a radiator in which coolant from an associated transversely mounted internal combustion engine is circulated, said fan and said engine having rotational axes transverse to one another, said fan having a geared hub, a support adjacent to the radiator, electric motor means mounted on said support having a rotatable output directly connected to said fan for the direct drive thereof, said fan being rotatably driven at a substantially constant speed by said motor and independent of engine speed for inducing the flow of air through said radiator, mechanical drive means comprising a flexible cable originating from said engine and having a rotatable output in parallel with said first mentioned output overrunning clutch means driven by said output of said cable, gear means drivingly connecting the output of said clutch means to the geared hub of said fan so that said electric motor means powers said fan at low engine speeds including idle speed range and said mechanical drive powers the fan for a range of engine speeds above idle engine speeds.

* * * * *